US007515985B2

(12) United States Patent
Suzuki et al.

(10) Patent No.: US 7,515,985 B2
(45) Date of Patent: Apr. 7, 2009

(54) EMBROIDERY DATA PROCESSING DEVICE AND COMPUTER PROGRAM PRODUCT

(75) Inventors: Mikitoshi Suzuki, Nagoya (JP); Masahiro Mizuno, Nagoya (JP); Shoichi Taguchi, Nagoya (JP); Yukiyoshi Muto, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 316 days.

(21) Appl. No.: 11/453,002

(22) Filed: Jun. 15, 2006

(65) Prior Publication Data

US 2007/0088452 A1 Apr. 19, 2007

(30) Foreign Application Priority Data

Jul. 4, 2005 (JP) ..... 2005-195137

(51) Int. Cl.
*D05C 5/02* (2006.01)
*D05B 19/00* (2006.01)

(52) U.S. Cl. ..... 700/138; 112/470.05

(58) Field of Classification Search ..... 700/138; 112/470.05

See application file for complete search history.

(56) References Cited

U.S. PATENT DOCUMENTS 4,849,902 A * 7/1989 Yokoe et al. ..... 112/470.04
4,982,674 A * 1/1991 Hayakawa ..... 112/102.5
4,998,489 A * 3/1991 Hisatake et al. ..... 112/103
5,189,622 A * 2/1993 Hayakawa et al. ..... 700/138
5,748,480 A * 5/1998 Mizuno ..... 700/138

FOREIGN PATENT DOCUMENTS

JP A 11-81125 3/1999

* cited by examiner

*Primary Examiner*—Albert DeCady
*Assistant Examiner*—Thomas H Stevens
(74) *Attorney, Agent, or Firm*—Oliff & Berridge, PLC

(57) ABSTRACT

The disclosure presents an embroidery data processing device and a computer program product capable of tearing off an elastic sheet easily after an item of embroidery has been sewn, thus enhancing working efficiency. A CPU extracts a contour line from needle drop points PN (N=1, 2, . . . , n) stored in embroidery data (S1 to S3). When the CPU judges that each needle drop point QN on the contour line is separated from an adjacent needle drop point Q (N+1) by more than a specified distance, the CPU forms needle drop points between adjacent needle drop points QN and, Q (N+1) separated from each other by more than a specified distance, reads out from a ROM tearing stitch data for forming a stitch of satin stitching different in stitch width in an inside direction of an embroidery region, and adds the tearing stitch data to the embroidery data so that a sewing sequence of stitches of satin stitching is ahead of a sewing sequence of stitches of the embroidery pattern main body in the embroidery region (Yes at S4 to S6).

20 Claims, 12 Drawing Sheets

EMBROIDERY DATA PROCESSING DEVICE AND COMPUTER PROGRAM PRODUCT

CROSS-REFERENCE TO RELATED APPLICATIONS

This application claims priority from JP 2005-195137, filed on Jul. 4, 2005, the contents of which are hereby incorporated by reference.

TECHNICAL FIELD

The disclosure relates to an embroidery data processing device and a computer program product, and more particularly to an embroidery data processing device and a computer program product for forming three-dimensional embroidery on a sheet for three-dimensional embroidery to be sewn by laminating a thick and elastic sheet on the surface of a sheet-like substrate.

BACKGROUND

Hitherto, various proposals have been made with regard to forming an item of three-dimensional embroidery on a sheet for three-dimensional embroidery to be sewn by laminating a thick and elastic sheet on the surface of a sheet-like substrate.

For example, using a sheet for three-dimensional embroidery to be sewn by laminating a thick and elastic sheet on the surface of a sheet-like substrate, proposals have been made to form an item of three-dimensional embroidery sewn into the inner side of an embroidery stitch so as to swell part of the elastic sheet to the surface side by sewing an embroidery pattern in a state in which the tension of the needle thread is relaxed on the sheet for three-dimensional embroidery (see, for example, Japanese Patent Application Laid-Open No. H11 (1999)-81125, paragraphs [0022] to [0071], and FIGS. 1 to 24).

However, in conventional methods of forming three-dimensional embroidery, when removing an elastic sheet such as a sponge from the sheet-like substrate, in the area near the needle drop point (a portion of sewing needle penetrating through the fabric) on the contour line of the embroidery pattern, the elastic sheet can be easily torn off after the embroidery has been sewn. However, away from the needle drop point disposed on the contour line, that is, if the needle drop point on the contour line is separately by more than a specified distance (for example, 0.25 mm to 1.0 mm), in order to remove the elastic sheet in this portion, it is necessary to cut off the elastic sheet by using scissors or a cutter along the contour line, and the task of removing the elastic sheet is complicated.

Alternatively, in order that the elastic sheet may be easily torn off after an item of three-dimensional embroidery has been sewn if an attempt is made to compile embroidery data having a needle drop point disposed closely to the contour line of the embroidery pattern shape, a skillful technique for composing data is needed, manual data input of the needle drop point is necessary, and much time and labor will be required.

SUMMARY

The disclosure has been made in view of the above circumstances and has an object to overcome the above problems and to provide an embroidery data processing device and a computer program product that in circumstances where a needle drop point is not disposed close to a contour line extracted from embroidery data of three-dimensional embroidery, that is, in circumstances where a needle drop point-exists on a contour line that is separated by more than a specified distance, are capable of automatically compiling stitch data, and of adding to embroidery data for forming a specified stitch to form a needle drop point near such a portion, thus facilitating tearing apart of an elastic sheet after the sewing of three-dimensional embroidery, and enhancing working efficiency.

To achieve the purpose of the disclosure, there is provided an embroidery data-processing device that includes a contour-extracting device that extracts a contour line for depicting an embroidery region on the basis of pattern data; and an embroidery data-creating device that creates embroidery data in order to form an embroidery stitch within the contour line. The embroidery data-processing device also includes a judging device that judges on the basis of the embroidery data whether adjacent needle drop points separated from each other by more than a specified distance on the contour line exist among needle drop points on the contour line. The embroidery data-processing device further includes a stitch data-adding device that adds to the embroidery data. The stitch data of a specific stitch is to be formed so that a needle drop point may be disposed nearby on the contour line between the adjacent needle drop points when the judging device judges that adjacent needle drop points separated from each other by more than a specified distance do exist on the contour line.

In this embroidery data processing device, the contour line for depicting the embroidery region can be extracted on the basis of pattern data. Within this contour line, embroidery data for forming embroidery stitches is formed. On the basis of the embroidery data, if among needle drop points on the contour line adjacent needle drop points exist that are separated by more than a specified distance on the contour line, stitch data of specific stitches are added to the embroidery data so that needle drop points on the contour line between adjacent needle drop points may be disposed closely to each other.

As a result, if portions exist that are separated by more than a specified distance among needle drop points on the contour line, stitch data for forming specific stitches for forming needle drop points close to these portions may be compiled automatically and added to the embroidery data. Accordingly, when forming an item of three-dimensional embroidery within the contour lines on the sheet for three-dimensional embroidery sewn by laminating a thick and elastic sheet on the surface of the sheet-like substrate, the elastic sheet can be easily torn off after the sewing of this three-dimensional embroidery, and working efficiency can be enhanced. Furthermore, a skilled technique is not required for data making when three-dimensional embroidery data is compiled. An inexperienced user can easily and fully tear off the elastic sheet such as a sponge after sewing three-dimensional embroidery, and embroidery data that creates a genuine three-dimensional sensation can be easily compiled.

To achieve the above object, there is also provided an embroidery data-processing device that includes an embroidery data-reading device that reads in embroidery data including positional data of needle drop points for forming an embroidery stitch by means of an embroidering machine. The embroidery data-reading device also includes a contour-extracting device that extracts on the basis of embroidery data being read in by the embroidery-data reading device, and a contour line for depicting an embroidery region. The embroidery data-reading device further includes a judging device that judges on the basis of the embroidery data whether adjacent needle drop points separated from each other by more than a specified distance on the contour line exist among needle drop points on the contour line. The embroidery data-reading device also includes a stitch data-adding device that adds to the embroidery data. The stitch data of a specific stitch is to be formed so that a needle drop point may be disposed nearby on the contour line between the adjacent needle drop points when the judging device judges that adjacent needle drop points separated from each other by more than a specified distance do exist on the contour line.

The embroidery data processing device reads in the embroidery data including the positional data of needle drop points for forming embroidery stitches by means of the embroidering machine, and extracts a contour line for depicting the embroidery region corresponding to the embroidery data obtained. On the basis of this embroidery data, if among needle drop points on the contour line adjacent needle drop points exist that are separated from each other by more than a specified distance on the contour line, stitch data of specific stitches to be formed can be added to the embroidery data so that a needle drop point may be disposed in a close position between the adjacent needle drop points on the contour line.

As a result, if portions that are separated from each other by more than a specified distance exist between needle drop points on the contour line, stitch data for forming a specified stitch that forms a needle drop point close to this portion can be automatically compiled and added to the embroidery data. Accordingly, when forming an item of three-dimensional embroidery within the contour line on the sheet for three-dimensional embroidery to be sewn by laminating a thick and elastic sheet on the surface of a sheet-like substrate, the elastic sheet can be torn off easily after the item of three-dimensional embroidery has been sewn, working efficiency can be enhanced. Furthermore, a skilled technique is not required for data making when three-dimensional embroidery data is compiled. An inexperienced user can easily and fully tear off the elastic sheet such as a sponge after sewing three-dimensional embroidery, and embroidery data that creates a genuine three-dimensional sensation can be easily compiled.

To achieve the above object, there is also provided a computer program product used and executed by an embroidery data-processing device that includes a recording medium that can be read by a computer; and a computer program stored in the recording medium that can be read by the computer. The computer program includes the following steps. A contour extracting step of extracting a contour line for depicting an embroidery region on the basis of pattern data. An embroidery data creating step of creating embroidery data in order to form an embroidery stitch within the contour line. A judging step of judging, on the basis of the embroidery data, whether adjacent needle drop points separated from each other by more than a specified distance on the contour line exist among needle drop points on the contour line. A stitch data-adding step of adding to the embroidery data, stitch data of specified stitch to be formed so that a needle drop point may be disposed closely on the contour line between the adjacent needle drop points when the judging device judges that adjacent needle drop points separated from each other by more than a specified distance do exist on the contour line.

In the computer program product, the computer reads in the program recorded in the recording medium, and extracts a contour line for depicting the embroidery region on the basis of pattern data. The computer further compiles embroidery data for forming an item of three-dimensional embroidery on the contour line. The computer judges whether adjacent needle drop points exist that are separated from each other by more than a specified distance on the contour line. When the computer judges that adjacent needle drop points separated from each other by more than a specified distance do exist on the contour line, stitch data of a specific stitch to be formed is added to the embroidery data so that a needle drop point may be closely disposed on the contour line between the adjacent needle drop points.

As a result, if portions separated from each other by more than a specified distance do exist between needle drop points on the contour line, the stitch data for forming specified stitches that forms a needle drop point close to this portion is automatically compiled and added to the embroidery data. Accordingly, when forming an item of three-dimensional embroidery within the contour line on the sheet for three-dimensional embroidery to be sewn by laminating a thick and elastic sheet on the surface of a sheet-like substrate, the elastic sheet can be torn off easily after the three-dimensional embroidery has been sewn, and working efficiency can be enhanced. Besides, a skillful technique is not required for data-making when three-dimensional embroidery data is compiled. An inexperienced user can easily and fully tear off the elastic sheet such as a sponge after sewing three-dimensional embroidery, and embroidery data that creates a genuine three dimensional sensation can be easily compiled.

To achieve the above object, there is also provided a computer program product used and executed by an embroidery data-processing device that includes a recording medium that can be read by a computer; and a computer program stored in the recording medium that can be read by the computer. The computer program includes the following steps. An embroidery data-reading step of reading in embroidery data including positional data of needle drop points for forming an embroidery stitch by means of an embroidering machine. A contour-extracting step of extracting, on the basis of embroidery data read in by the embroidery reading device, a contour line for depicting an embroidery region. A judging step of judging, on the basis of the embroidery data, whether adjacent needle drop points separated from each other by more than a specified distance on the contour line exist among needle drop points on the contour line. A stitch data-adding step of adding to the embroidery data, stitch data of a specific stitch to be formed so that a needle drop point may be disposed nearby on the contour line between the adjacent needle drop points when the judging device judges that adjacent needle drop points separated from each other by more than a specified distance on the contour line.

In the computer program product, by reading in a program recorded in the recording medium, the computer reads in embroidery data including positional data of needle drop points for forming embroidery stitches by means of the embroidering machine and extracts a contour line for depicting the embroidery region corresponding to the embroidery data. The computer judges whether adjacent needle drop points separated from each other by more than a specified distance exist on the contour line. If the computer judges that adjacent needle drop points separated from each other by more than a specified distance do exist on the contour line, stitch data of a specified stitch to be formed is added to the embroidery data so that a needle drop point may be closely disposed on the contour line between the adjacent needle drop points.

As a result, if portions separated from each other by more than a specified distance exist between needle drop points on the contour line, the stitch data for forming a specified stitch that forms a needle drop point close to this portion is automatically compiled and added to the embroidery data. Accordingly, when forming an item of three-dimensional embroidery within the contour line on the sheet for three-dimensional embroidery to be sewn by laminating a thick and elastic sheet on the surface of a sheet-like substrate, the elastic sheet can be torn off easily after three-dimensional embroidery has been sewn, and working efficiency can be enhanced. Furthermore, skillful technique is not required for data-making when three-dimensional embroidery data is compiled. An inexperienced user can easily and fully tear off the elastic sheet such as a sponge after sewing three-dimensional embroidery, and embroidery data that creates a genuine three-dimensional sensation can be easily compiled.

DETAILED DESCRIPTION

A detailed description of the first and second preferred exemplary embodiments of the embroidery data processing device and the computer program product of the disclosure will now be given, with reference to the accompanying drawings. First, an outline of the embroidery data processing device in exemplary embodiment 1 is described according to FIG. 1.

EXEMPLARY EMBODIMENT 1

Figure 1:
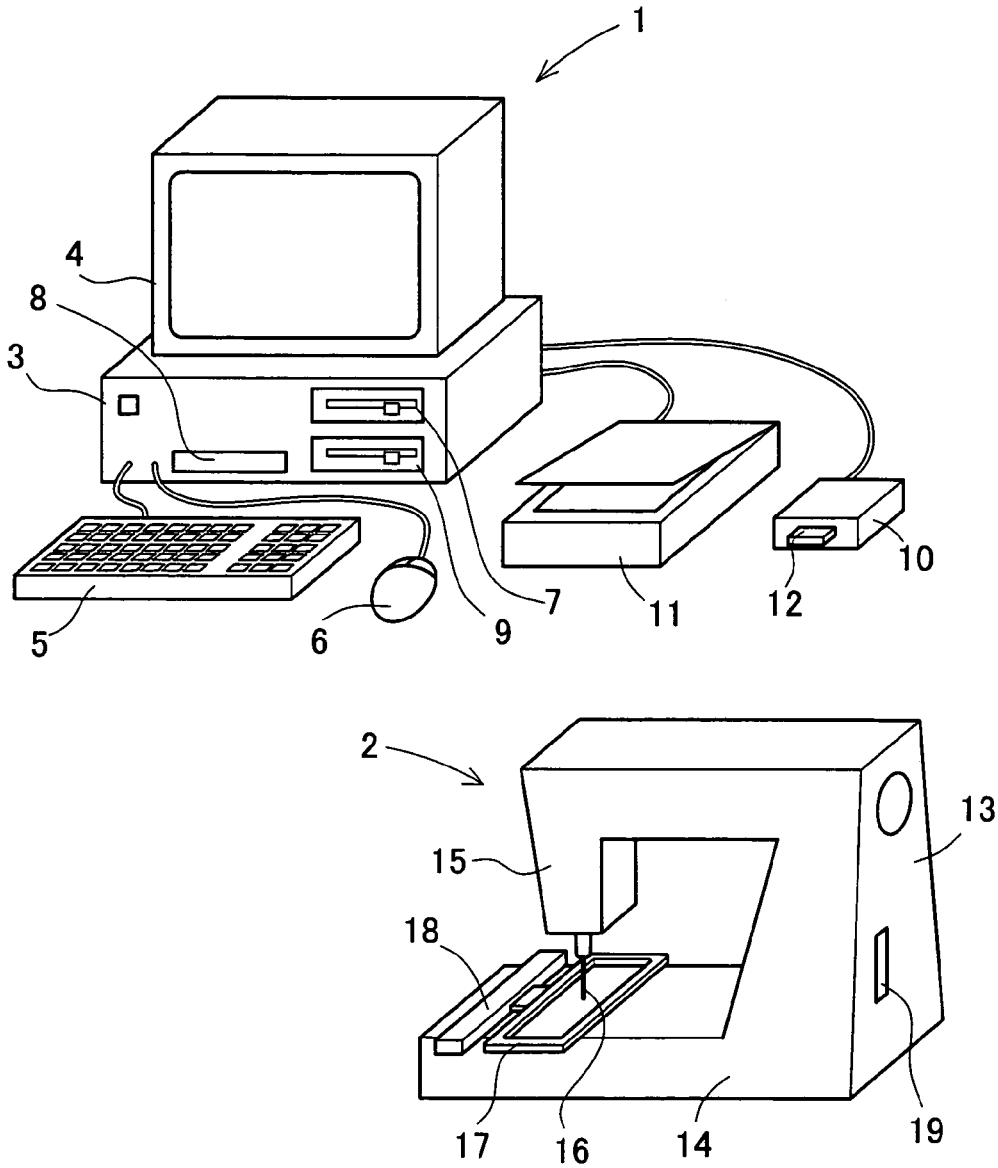
FIG. 1 is a perspective view of an outline of an embroidery data processing device in exemplary embodiment 1.

In FIG. 1, an embroidery data processing device 1 is mainly composed of control main body 3. The control main body 3 has a Cathode-Ray Tube (CRT) display 4 for displaying images, patterns and text. The control main body 3 also includes a keyboard 5, a mouse 6, a flexible disk (FD) device 7, a hard disk drive 8, a CD-ROM device 9, a flash memory device 10, and an image scanner 11.

In the flexible disk device 7, as a recording medium storing various programs, an including embroidery data processing program described later, a flexible disk 7A (see FIG. 2) is set detachably. The hard disk drive 8 is designed to save image data, outline data, and embroidery data in the hard disk, or read out from the hard disk. The CD-ROM device 9 is designed to read out the image data, outline data, and embroidery data recorded in the CD-ROM. The flash memory device 10 has a detachable memory card 12 composed of a nonvolatile flash memory, and embroidery data is written in the memory card 12. The image scanner 11 reads in the original image of an embroidery pattern.

Various programs such as an embroidery data processing program and others mentioned below may be recorded not only in flexible disk 7A, but also in other computer-readable recording media, such as a semiconductor memory, the hard disk, a data card (IC card, magnetic card, etc.), an optical disk (CD-ROM, DVD, etc.), a magneto-optical disk (MD, etc.), a phase change disk, and magnetic tape, and use of programs may be started by loading in a computer as required. Further, programs may be recorded in a ROM or a back-up RAM, and such a ROM or back-up RAM may be incorporated in the computer.

A sewing machine main body 13 of embroidering machine 2 has an arm 15 formed integrally above a bed 14. At the leading end of the arm 15, a needle bar (not shown) having sewing needle 16 is provided. Above the bed 14, an embroidery frame 17 is disposed for holding a fabric (not shown). The embroidery frame 17 is designed so as to be moved by an embroidery frame moving mechanism 18 to a desired position according to the original system of XY coordinates of the device. By driving the needle bar and hook mechanism (not shown), while freely moving the fabric by means of the embroidery frame moving mechanism 18, an embroidery-forming operation for forming a specified item of embroidery on the fabric can be executed.

A card slot 19 for loading a memory card 12 is provided at the right side of the sewing machine main body 13.

The embroidery frame moving mechanism 18, the needle bar and other items of equipment are controlled by a control device (not shown) composed of a microcomputer and other items of equipment. Embroidery data is given to the control device from outside through the memory card 12. Therefore, stitch by stitch in the embroidery data, the control device can automatically execute an embroidering operation on the basis of the data for instructing the extent of movement (needle drop point) in a XY direction of the fabric stitch.

Figure 2:
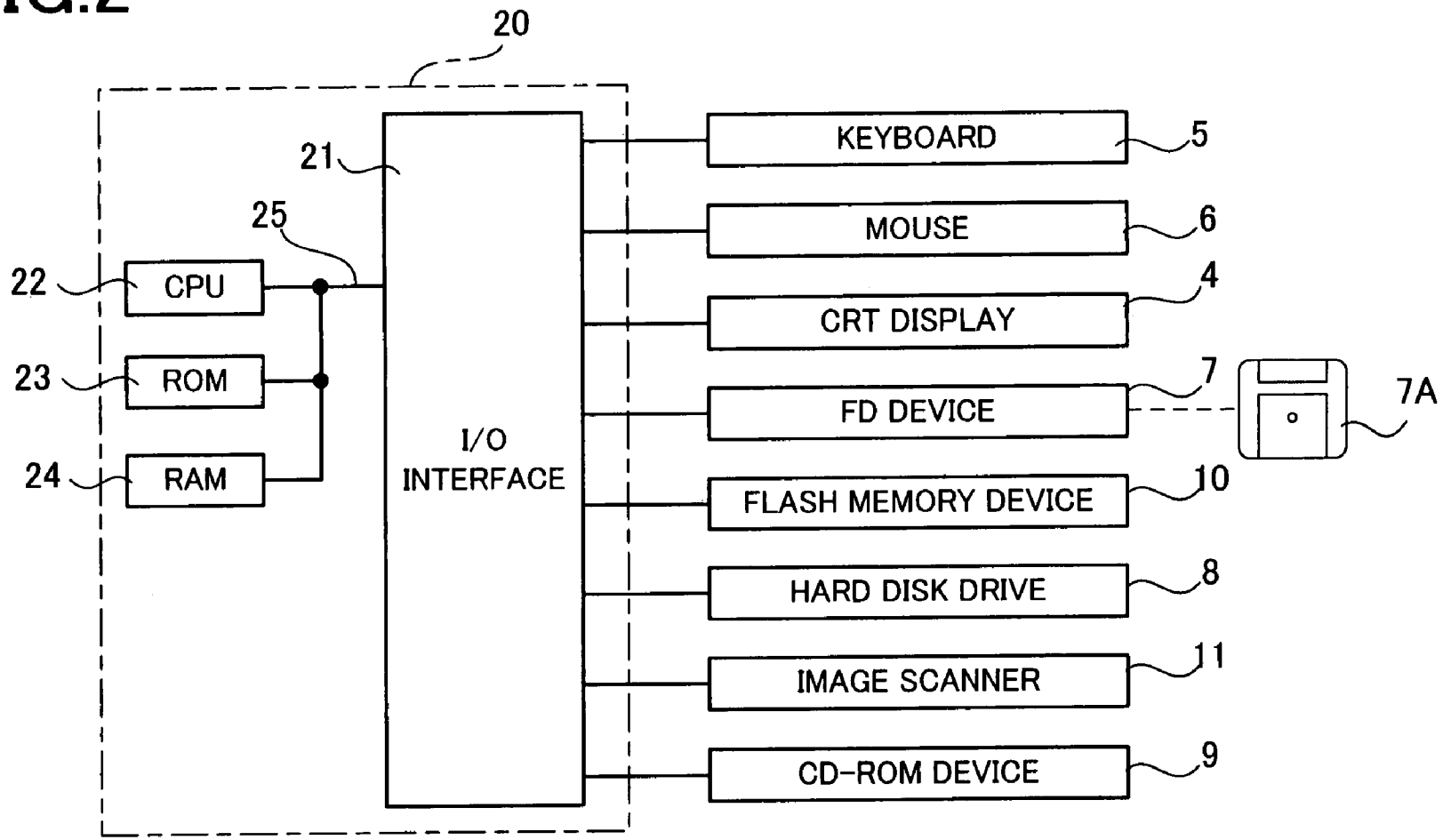
FIG. 2 is a block diagram of a control system for the embroidery data processing device.

Next, an electrical configuration of the embroidery data processing device will be explained according to FIG. 2. FIG. 2 is a block diagram of the control system of the embroidery data processing device.

In FIG. 2, the control device 20 incorporated in the control main body 3 is a circuit composed mainly of a microcomputer, and is constructed by mutually connecting input/output (IO) interface 21, CPU 22, ROM 23, and RAM 24 through bus line 25.

The I/O interface 21 incorporates CRT display 4, keyboard 5, mouse 6, flexible disk (FD) device 7, flash memory device 10, hard disk drive 8, image scanner 11, and CD-ROM device 9.

In this configuration, the control device 20 reads in the embroidery data processing program or embroidery data stored in the flexible disk 7A through the flexible disk device 7, and executes an embroidery data creating process according to the program obtained.

The ROM 23 stores a control program necessary for operating the embroidery data processing device 1, and various programs necessary for processing other embroidery data. The RAM 24 has an outline data memory area for storing outline data corresponding to the original image of embroidery that is read in through the image scanner 11, an embroidery data memory area for storing embroidery data created according to outline data and embroidery data that is read out from the flexible disk 7A, and various data memory regions necessary for creating other embroidery data.

In the embroidery data processing device 1 having such a configuration, the process for adding to embroidery data of three-dimensional embroidery tearing stitch data for forming a stitch for tearing off an elastic sheet such as a sponge is explained with reference to FIG. 3 to FIG. 8.

Figure 3:
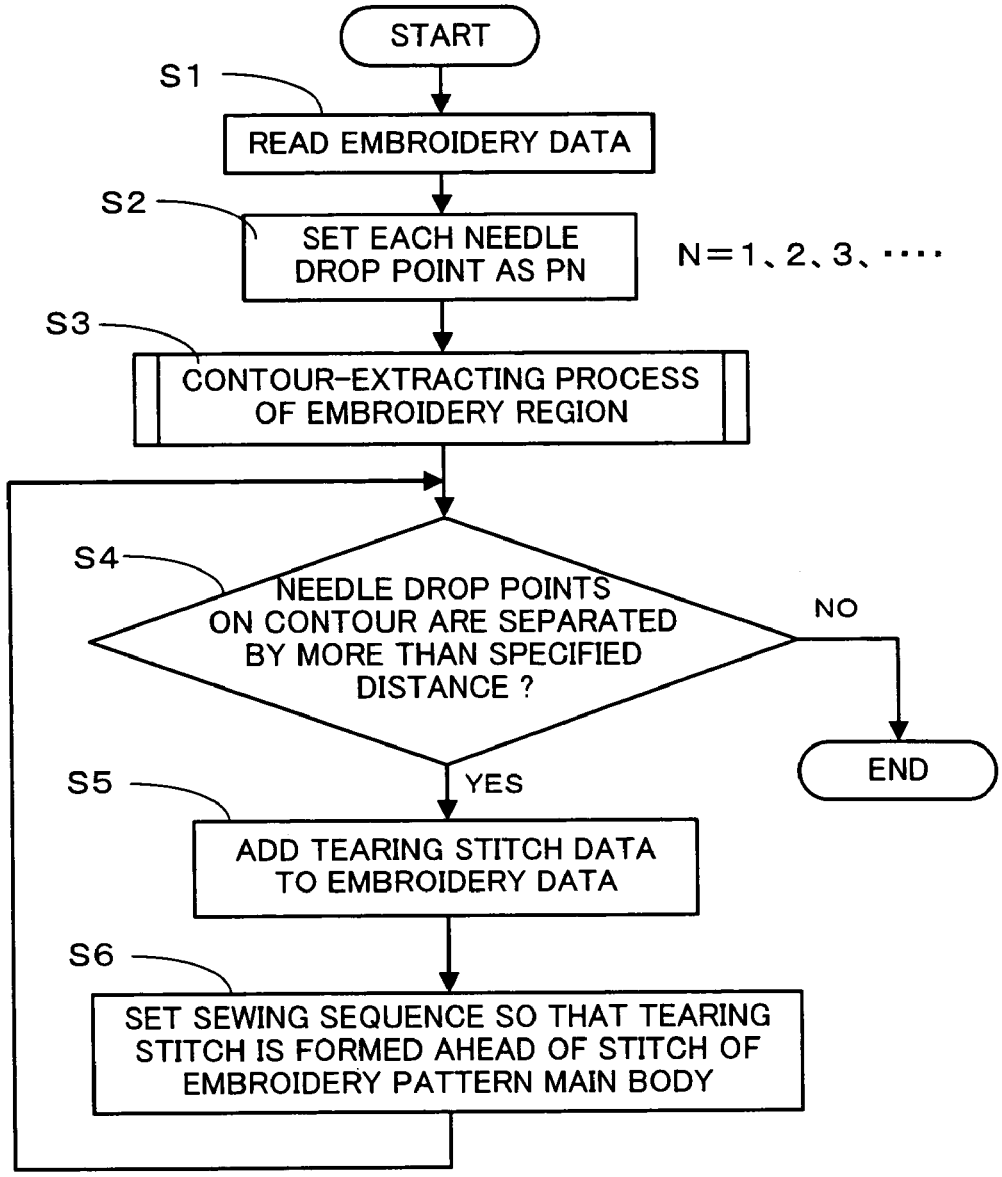
FIG. 3 is a flowchart of a processing program for adding to embroidery data of three-dimensional embroidery, stitch data for forming a stitch that tears off an elastic sheet.

As shown in FIG. 3, at S1 (step 1), when the flexible disk 7A storing embroidery data is loaded in the flexible disk device 7, and specified input is made from the keyboard 5 or mouse 6, the CPU 22 reads in the embroidery data from the flexible disk 7A through the flexible disk device 7A, on the basis of the program stored in the ROM 23, and stores in the embroidery data memory area within the RAM 24. The embroidery data is so-called stitch data in which positional coordinates can be stored on the elastic sheet of each needle drop point according to a sewing procedure.

At S2, the CPU 22 sets each needle drop point stored in the embroidery data (a total of n points), as PN, in a sewing sequence (N=1, 2, . . . , n).

Next at S3, the CPU 22 extracts the contour line from each needle drop point PN by a known contour line extracting process (see, for example, Japanese Patent Application Laid-Open No. H10 (1998)-13740).

Figure 4:
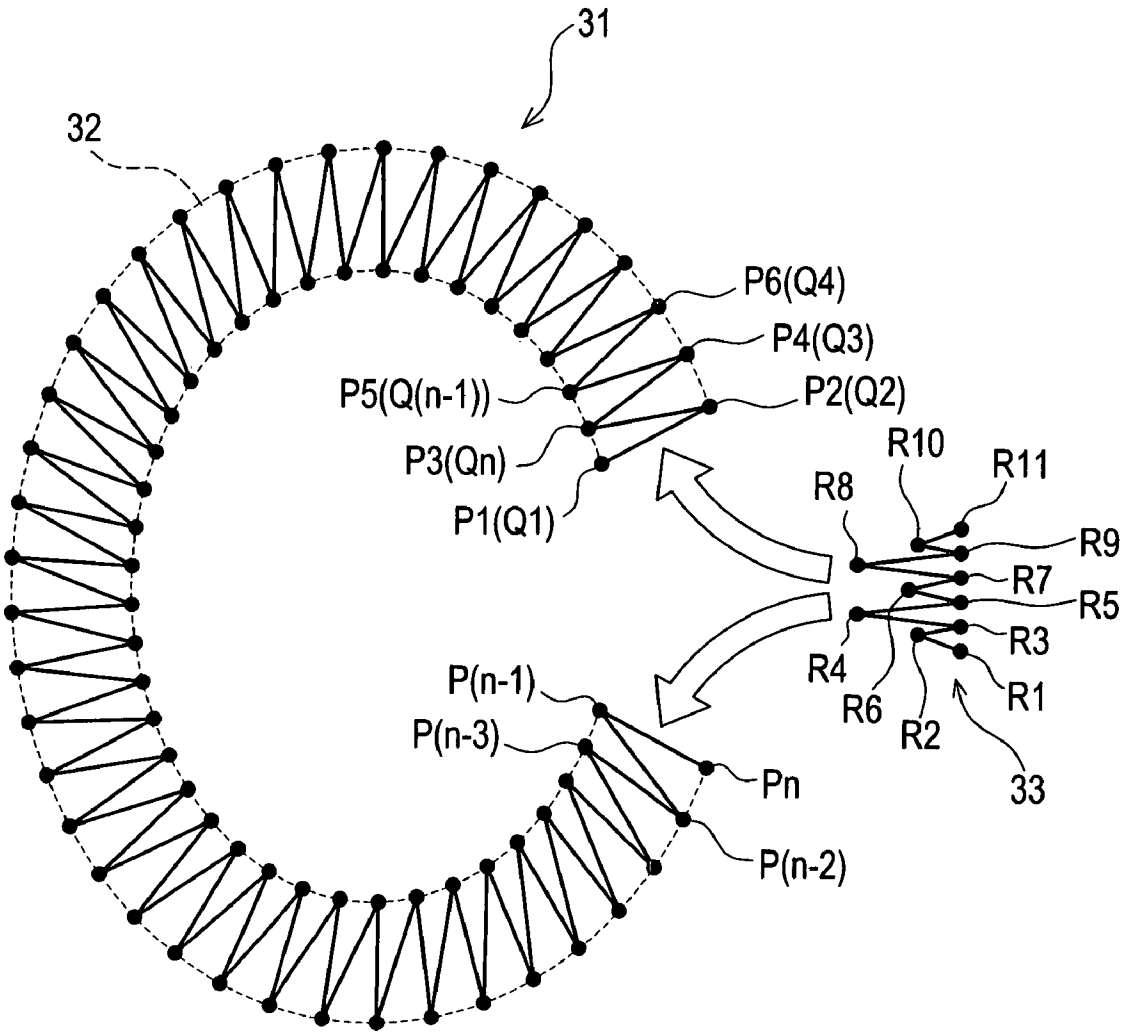
FIG. 4 is a diagram showing, among needle drop points formed on a contour line extracted from embroidery data, an example of portions separated from each other by more than a specified distance.

As shown in FIG. 4, for example, for purposes of composing three-dimensional embroidery in the shape of a letter "C", if needle drop points of embroidery data of stitch 31 (hereinafter called embroidery data 31) are P1, P2, P3, . . . , P(n−1), and Pn, the CPU 22 extracts a contour line 32 linked in the sequence of needle drop points P1, P2, P4, P6, . . . , P(n−2), Pn, P(n−1), P(n−3), . . . , P5, P3, and P1.

In the following explanation, needle drop points arranged sequentially on the contour line 32 extracted are deemed to be needle drop points Q1, Q2, Q3, Q4, . . . , Q(n−1), and Qn, as shown in FIG. 4.

Later, at S4, the CPU 22 judges needle drop points QN (N=1, 2, . . . , n) on the contour line to check whether or not adjacent needle drop points Q (N+1) are separated from each other by more than a specified distance (for example, 0.25 mm to 1.0 mm or more) in the sequence of Q1, Q2, Q3 . . . , Qn.

When needle drop point QN on the contour line and adjacent needle drop point Q (N+1) are judged not to be separated from each other by more than a specified distance (No at S4), the CPU 22 terminates this process.

For example, in the case of three-dimensional embroidery of letter "B", needle drop point QN on the contour line and adjacent needle drop point Q (N+1) are judged not to be separated from each other by more than a specified distance, and stitch data for forming a stitch for tearing off the elastic sheet is not added to the embroidery data.

On the other hand, when needle drop point QN on the contour line and adjacent needle drop point Q (N+1) are judged to be separated from each other by more than a specified distance (Yes at S4), the CPU 22 proceeds to the process at S5.

At S5, the CPU 22 reads out from the ROM 23 tearing stitch data, hereafter referred to as tearing stitch data 33D for forming tearing stitch 33 for forming a needle drop point close to the adjacent needle drop points QN and Q (N+1) separated from each other by more than a specified distance. Further, the CPU 22 adds tearing stitch data 33D to the embroidery data 31, and stores in the embroidery data memory area.

This tearing stitch 33 is a stitch of satin stitching having outside needle drop points RN (N=1, 3, 5, . . . ) disposed on the contour line, and inside needle drop points R (N+1) disposed at a different stitch width in the inside direction of the embroidery region.

Figure 5:
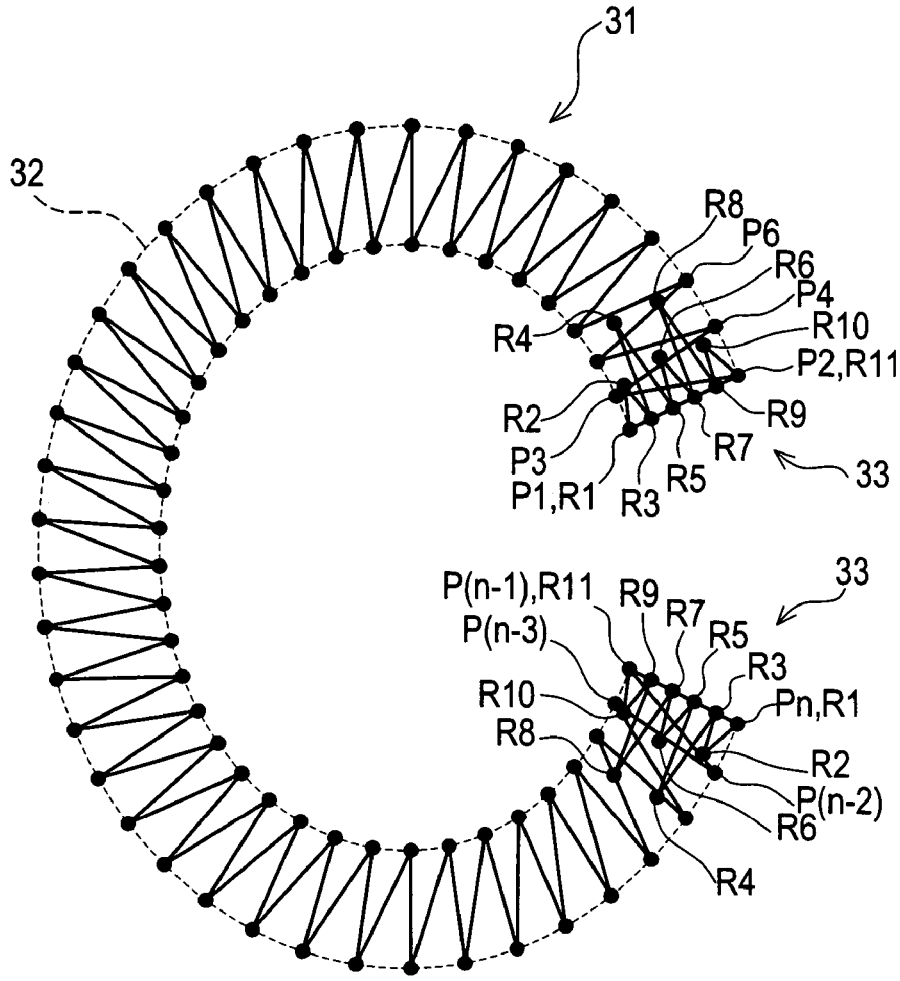
FIG. 5 is a diagram showing an example of stitch data of satin stitching that has been added, and that different in stitch width in an inside direction to a portion separated in needle drop point by more than a specified distance.

For example, as shown in FIG. 4 and FIG. 5, the CPU 22 judges the distance between needle drop point P1 and needle drop point P2, and needle drop point P (n−1) and needle drop point Pn on the contour line 32 are separated from each other by more than a specified distance (Yes at S4). Consequently, the CPU 22 adds each of the tearing stitch data 33D for forming needle drop points near needle drop points P1 and P2, and needle drop points P (n−1) and Pn, to embroidery data 31 of letter "C", and stores in the embroidery data memory area (S5).

This tearing stitch data 33D is embroidery data for forming a stitch of satin stitching, so that outside needle drop points R1, R3, R5, R7, R9, R11 may be disposed on the contour line between adjacent needle drop points P1 and P2, and between needle drop points P (n−1) and Pn that are separated from each other by more than a specified distance, and so that inside needle drop points R2, R4, R6, R8, R10 may be disposed in such a way as to be increased in stitch width at every second drop point in the inside direction within the embroidery region.

At S6, the CPU 22 makes a setting once again so that the sewing sequence of tearing stitch data added and stored in the embroidery data memory area is ahead of the sewing sequence of embroidery data of the embroidery pattern main body, and again executes the process that follows S4. When the needle drop point QN on the contour line is judged not to be separated by more than a specified distance from adjacent needle drop point Q (N+1) (No at S4), the CPU 22 terminates this process.

As a result, the sewing sequence is determined so that the stitch added for tearing off an elastic sheet such as a sponge may be formed ahead of the stitch of the embroidery pattern main body. Therefore, the stitch added for tearing off is covered at the upper side by the stitch of the embroidery pattern main body.

For example, as shown in FIG. 5, the CPU 22 stores data in the embroidery data memory area of RAM 24 so that the sewing sequence of tearing stitch data 33 is ahead of the sewing sequence of embroidery data 31 of letter "C".

Embroidery data shown in FIG. 5 is recorded in the memory card 12 through flash memory device 10, and this memory card 12 is loaded into the card slot 19 of embroidering machine 2. An example of sewn three-dimensional embroidery is explained in FIG. 6 to FIG. 8.

Figure 6:
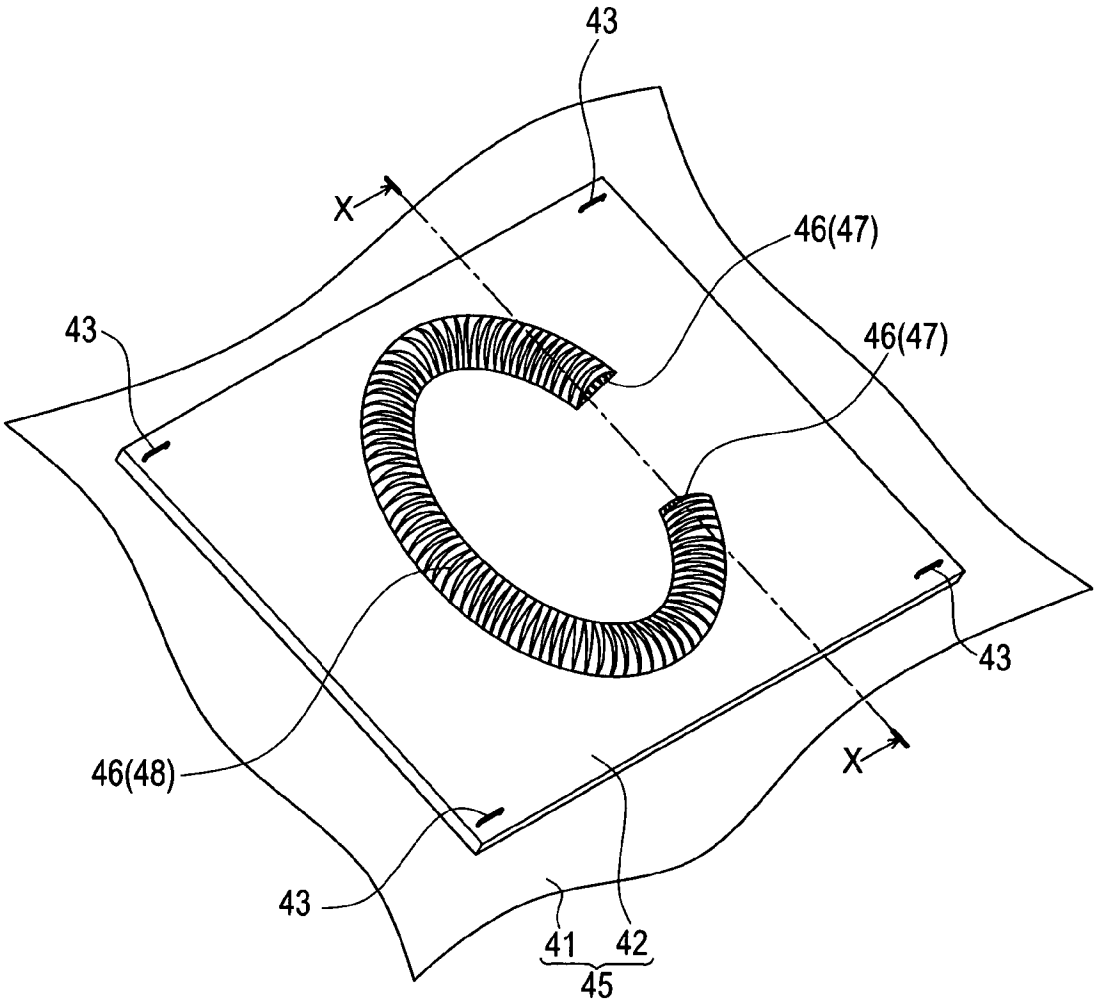
FIG. 6 is a perspective view of an example of three-dimensional embroidery for which stitch data of satin stitching has been added to a portion separated in needle drop point by more than a specified distance.
Figure 7:
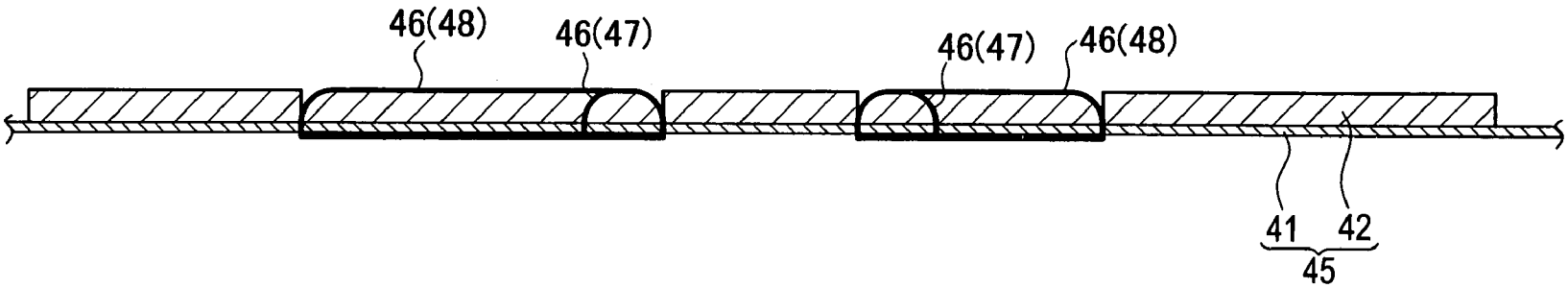
FIG. 7 is a sectional view of X-X in FIG. 6.

As shown in FIG. 6 and FIG. 7, a thick and elastic sheet 42 is laminated on the surface of fabric 41 (corresponding to a sheet-like substrate), and the fabric 41 and elastic sheet 42 are integrally formed by means of a fastening needle or other fastener 43, and a sewable sheet for three-dimensional embroidery 45 is composed. The fabric 41 is preferably woven cloth or nonwoven cloth, but something like board paper or a sheet of synthetic resin may also be used. The elastic sheet 42 is preferably synthetic resin foam such as sponge, but, as long as the sheet composed for three-dimensional embroidery 45 can be sewn, a rubber elastic sheet may be also used.

With the needle thread 46 relaxed in tension on the three-dimensional embroidery sheet 45, the embroidering machine 2 sews according to the tearing stitch data 33D at each end of letter "C", and forms each embroidery stitch 47 of satin stitching. Next, with the needle thread 46 relaxed in tension on the three-dimensional embroidery sheet 45, the embroidering machine 2 sews an embroidery pattern "C" according to embroidery pattern 31 of letter "C", and thereby forms embroidery stitch 48.

Figure 8:
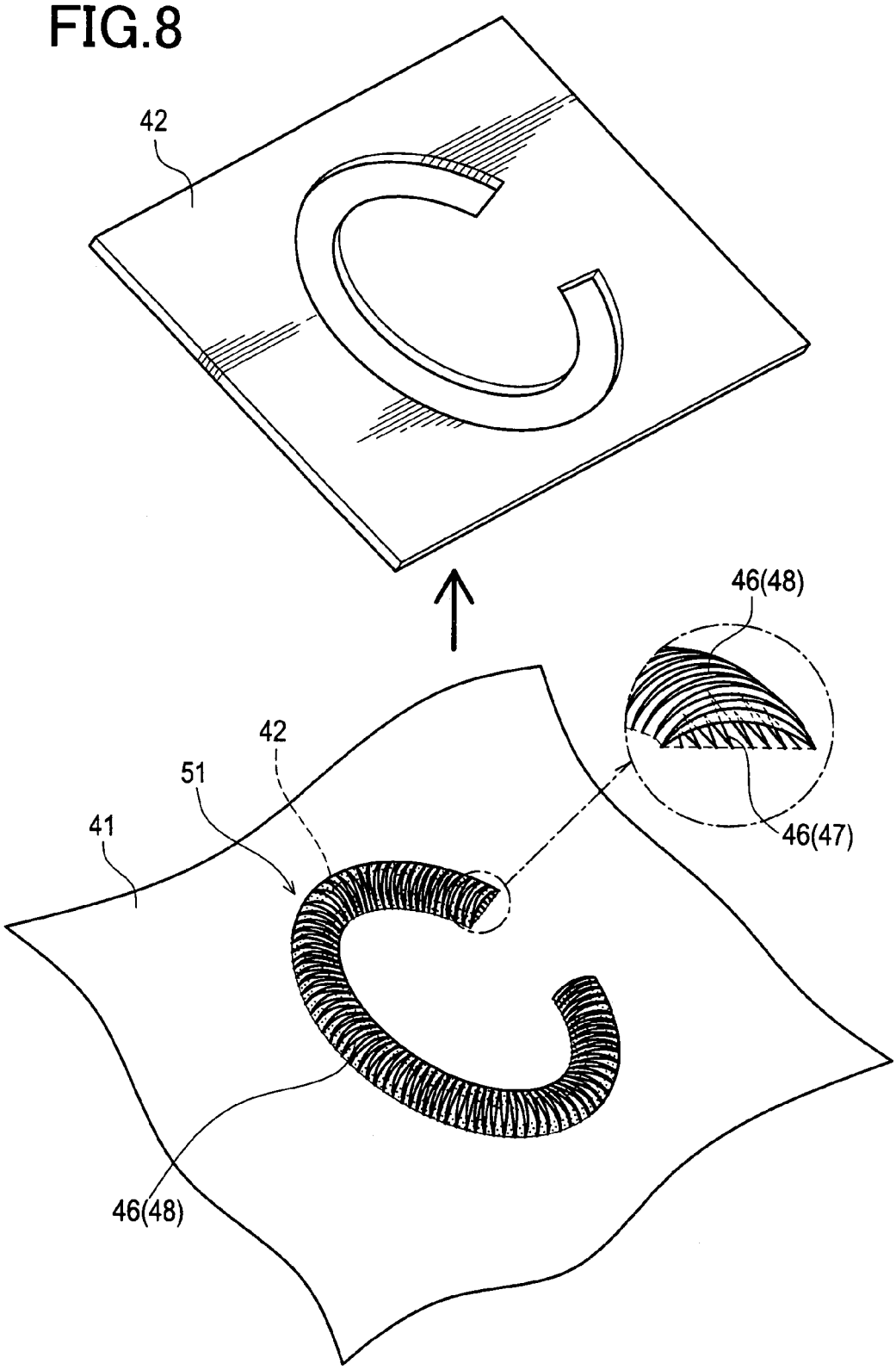
FIG. 8 is a perspective view of an elastic sheet that has been torn off after three-dimensional embroidery has been sewn in FIG. 6.

As a result, as shown in FIG. 8, a part of elastic sheet 42 is sewn into the insides of embroidery stitches 47, 48 so as to be swollen largely and uniformly to the surface side, and three-dimensional embroidery 51 of letter "C" is formed. When three-dimensional embroidery 51 is formed, the portions sewn into the insides of embroidery stitches 47, 48 of the elastic sheet 42, and other portions are torn off and separated by repeated vertical motions of sewing needle 16 of embroidering machine 2 at every inching feed, and in consequence the remaining unnecessary portions of the elastic sheet 42 can be easily torn off from the fabric 41.

When the remaining unnecessary portions of the elastic sheet 42 has been torn off from the fabric 41, three-dimensional embroidery 51 of letter "C" appears so as to create a genuine three-dimensional sensation, and with a clear finish. Various embroidery stitches 47 formed at various ends of letter "C" are concealed under the embroidery stitch 48 that forms embroidery pattern "C".

In the embroidery data processing device 1 in exemplary embodiment 1 as described above, the CPU 22 extracts a contour line from needle drop points PN (N=1, 2, . . . , n) stored in the embroidery data (S1 to S3). When the CPU 22 judges that needle drop point QN on a contour line is separated from an adjacent needle drop point Q (N+1) by more than a specified distance (Yes at S4), needle drop points RN (N=1, 3, 5, . . . ) are formed between adjacent needle drop points QN and Q (N+1) separated from each other by more than a specified distance, and tearing stitch data 33D for forming stitches 33 of satin stitching, which are different in terms of stitch width in an inside direction within the embroidery region is read out from the ROM 23, added to the embroidery data 31, and stored in the embroidery data memory area (S5).

As a result, if between needle drop points QN and Q (N+1) on a contour line of three-dimensional embroidery, portions exist that are separated from each other by more than a specified distance, tearing stitch data is created automatically for forming stitches of satin stitching different in stitch width in an inside direction in the embroidery region so as to form needle drop points RN close to these portions, and the tearing stitch data are added to the embroidery data. After three-dimensional embroidery has been sewn, the elastic sheet 42 can be easily torn off, and separated from the fabric 41, and working efficiency is enhanced. Furthermore, a skilled technique is not required for data making when three-dimensional embroidery data is compiled. An inexperienced user can easily and fully tear off the elastic sheet such as a sponge after sewing three-dimensional embroidery, and embroidery data that creates a genuine three-dimensional sensation can be easily compiled.

Since a stitch of satin stitching is different in stitch width in an inside direction of an embroidery region in relation to the contour line, after an item of three-dimensional embroidery has been sewn, a small protrusion is prevented from being formed by the inside stitch of satin stitching, and an improvement in appearance can be secured.

When adding to embroidery data, tearing stitch data of satin stitching having needle drop points disposed on a contour line, the tearing stitch data added in such a way that the sewing sequence of stitches of satin stitching is ahead of the sewing sequence of stitches of the embroidery pattern main body in the embroidery region (S6). As a result, the stitches of satin stitching disposed at a needle drop point on a contour line are concealed beneath the stitches of three-dimensional embroidery in an embroidery region to be sewn later, and in consequence excessive stitches are not conspicuous, and appearance may be further enhanced.

EXEMPLARY EMBODIMENT 2

An embroidery data processing device and a computer program product in exemplary embodiment 2 are explained with reference to FIG. 9. In the course of following explanation, the same reference numerals as for the embroidery data processing device 1 and computer program product in exemplary embodiment 1 illustrated in FIG. 1 to FIG. 8 indicate the same, or corresponding components in the embroidery data processing device 1 and computer program product in exemplary embodiment 2.

An outline of the embroidery data processing device in exemplary embodiment 2 is almost identical to those in the embroidery data processing device 1 in exemplary embodiment 1. Various control processes in the embroidery data processing device in exemplary embodiment 2 are also almost identical to those in the embroidery data processing device 1 in exemplary embodiment 1.

However, the embroidery data processing device in exemplary embodiment 2 is different from the embroidery data processing device 1 in exemplary embodiment 1, insofar that the embroidery data of three-dimensional embroidery is created on the pattern image data obtained from the original image by use of the image scanner 11.

The embroidery data processing device in exemplary embodiment 2 is explained below with reference to FIG. 9, in which tearing stitch data for forming a stitch for tearing off an elastic sheet such as a sponge is added to embroidery data for three-dimensional embroidery.

Figure 9:
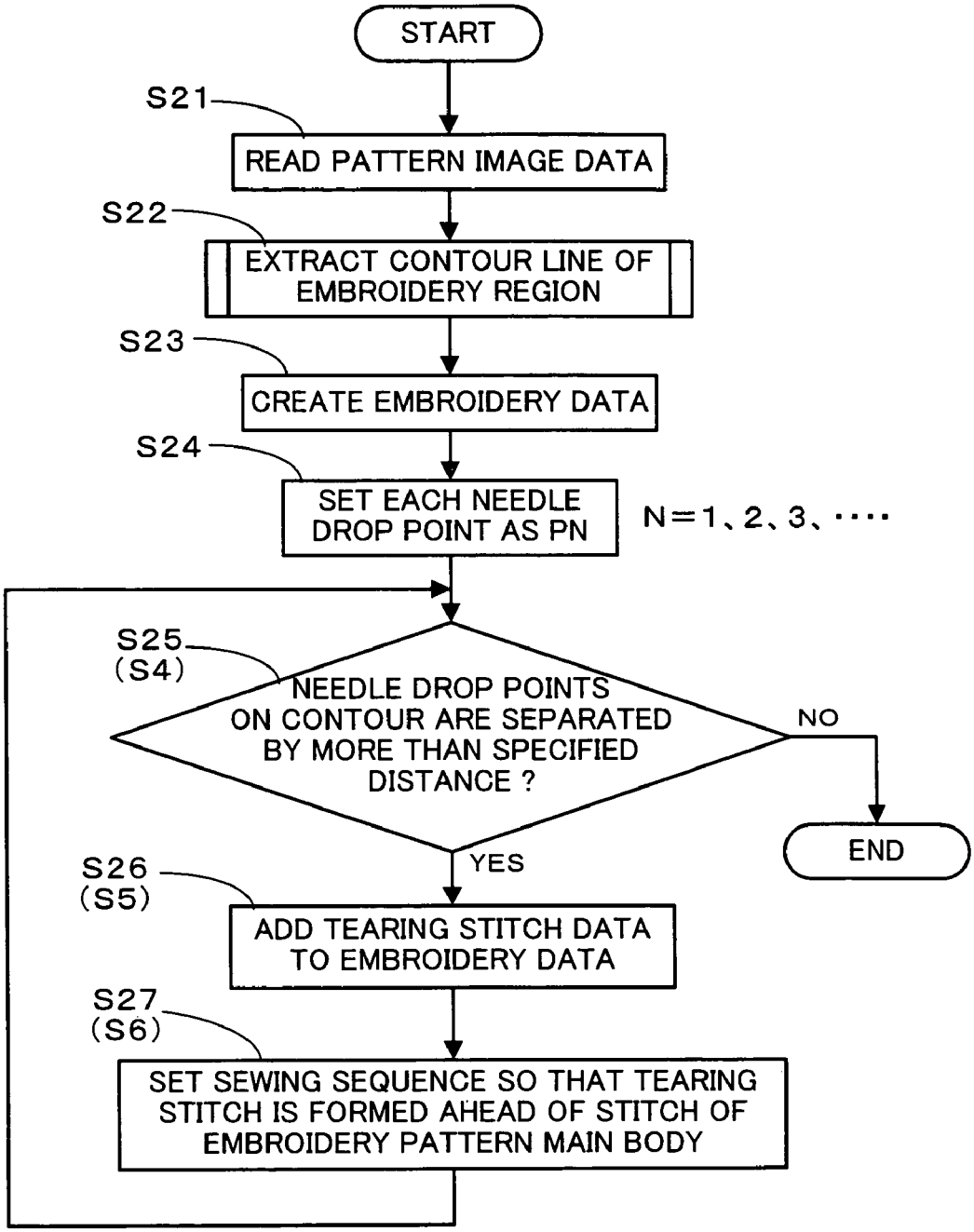
FIG. 9 is a flowchart of a processing program for adding to embroidery data of three-dimensional embroidery, stitch data for forming a stitch that tears off an elastic sheet in the embroidery data processing device at exemplary embodiment 2.

As shown in FIG. 9, at S21, the CPU 21 reads the original image of the pattern at a specified resolution (for example, 100 dpi to 200 dpi) by means of the image scanner 11, and stores in the RAM 24 the pattern image data of the original image. For example, the original pattern image of letter "C" is read by use of the image scanner 11, and this pattern image data is stored in the RAM 24.

At S22, the CPU 22 again reads out the pattern image data from the RAM 24, extracts a contour line of an embroidery region by a known contour line extracting process (see, for example, Japanese Patent Application Laid-Open No. H7 (1995)-136361), and stores this in the outline data memory area.

At S23, according to a known embroidery data compiling process (see, for example, Japanese Patent Application Laid-Open No. H7 (1995)-136361), the CPU 22 creates embroidery data about the embroidery region enclosed by the contour line. The embroidery data is so-called stitch data in which position of coordinates of each needle drop point are stored on an elastic sheet according to a sewing sequence.

Next, at S24, the CPU 22 sequentially extracts needle drop points on the contour line from needle drop points stored in embroidery data (in a total of n points), and determines as PN in a sewing sequence (N=1, 2, 4, 6, . . . , n, n−1, n−3, . . . , 5, 3, 1). For purposes of the following explanation, the needle drop points extracted and arranged sequentially on the contour line are deemed to be Q1, Q2, Q4, Q4, . . . , Q (n−1), and Qn, as shown in FIG. 4.

Consequently, as S25 to S27, the CPU 22 executes the process as of S4 to S6 described above, and terminates the process.

In the embroidery data processing device in exemplary embodiment 2 thus explained, the CPU 22 creates embroidery data about an embroidery region enclosed by a contour line from the pattern image data of the original image read by the image scanner 11 (S21 to S23). From the needle drop points stored in the embroidery data (in a total of n points), needle drop points on the contour line are extracted sequentially, and needle drop points Qn are determined in the sewing sequence (N=1, 2, . . . , n) (S24). Further, the CPU 22 judges whether or not needle drop points QN on the contour line (N=1, 2, . . . , n) are separated from an adjacent needle drop point Q (N+1) by more than a specified distance. If such a judgment is affirmative (Yes at S25), needle drop points RN (N=1, 3, 5, . . . ) are formed nearby between adjacent needle drop points QN and Q (N+1) separated from each other by more than a specified distance, and tearing stitch data 33D for forming stitches of satin stitching different in stitch width in an inside direction in an embroidery region is read out from the ROM 23, added to the embroidery data, and stored in the embroidery data memory area (S26).

As a result, if portions separated from each other by more than a specified distance exist between needle drop points QN and Q (N+1) on a contour line of three-dimensional embroidery, tearing stitch data are automatically created for forming stitches of satin stitching different in stitch width in an inside direction in an embroidery region so as to form needle drop points RN close to these portions, and added to the embroidery data, and after three-dimensional embroidery has been sewn, the elastic sheet 42 can be torn off easily, and easily separated from the fabric 41, and working efficiency can thereby enhanced. Besides, a skilled technique is not required for data making when three-dimensional embroidery data is compiled, and after sewing three-dimensional embroidery, even an inexperienced user can easily and fully tear off the elastic sheet 42 such as a sponge, so that three-dimensional embroidery data can be easily compiled.

Since a stitch of satin stitching is different in stitch width in an inside direction of an embroidery region in relation to the contour line, after an item of three-dimensional embroidery has been sewn, the small protrusion is prevented from being formed by the inside stitch of satin stitching, and an improvement in appearance can be secured.

When adding to embroidery data, tearing stitch data of satin stitching having needle drop points disposed on a contour line, the 5 tearing stitch data is added in such a way that the sewing sequence of stitches of satin stitching is ahead of the sewing sequence of stitches of the embroidery pattern main body in the embroidery region (S27). As a result, the stitches of satin stitching disposed at a needle drop point on a contour line are concealed beneath the stitches of three-dimensional embroidery in an embroidery region to be sewn later, and in consequence excessive stitches are not conspicuous, and appearance may be further enhanced.

The disclosure is not limited to exemplary embodiment 1 and exemplary embodiment 2, but may be improved and modified in various ways within a scope that does not depart from the true spirit of the disclosure.

EXEMPLARY EMBODIMENT 3

Figure 10:
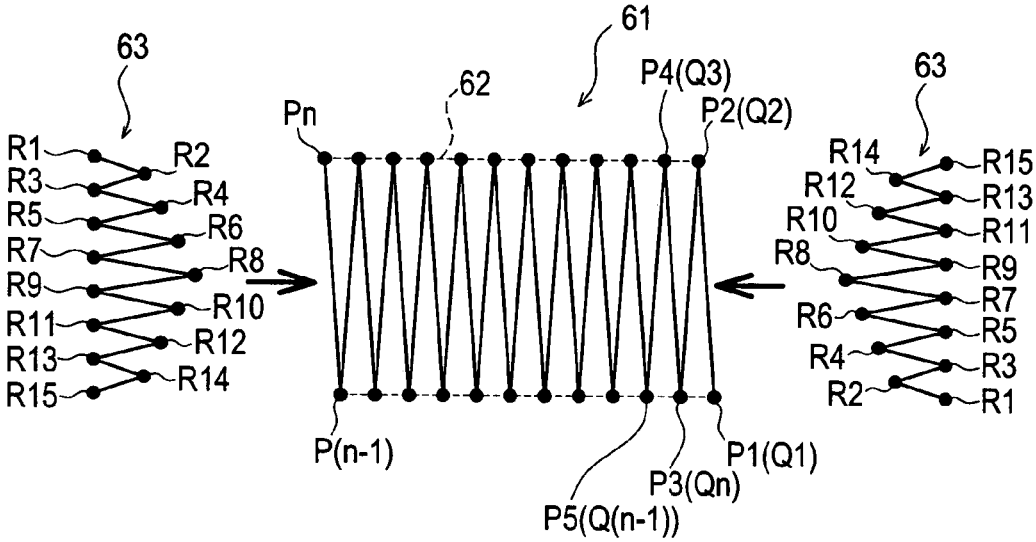
FIG. 10 is a diagram of an example of a portion among needle drop points formed on a contour line that have been extracted from embroidery data in the embroidery data processing device of another exemplary embodiment, separated by more than a specified distance.
Figure 11:
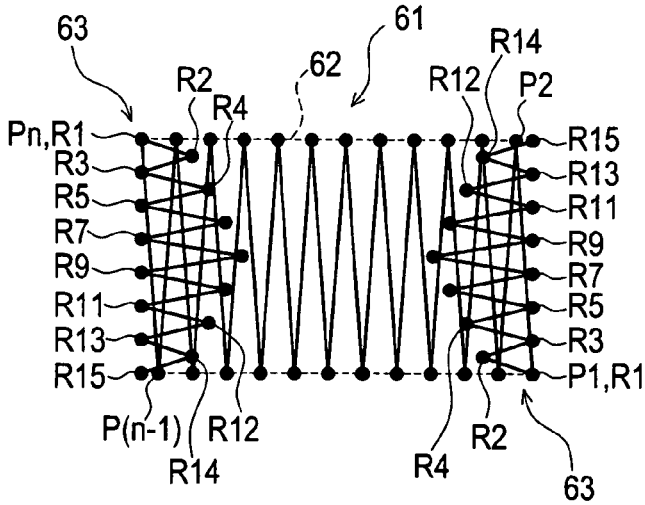
FIG. 11 is an explanatory diagram of a portion of stitch data of satin stitching that has been added, and is different in stitch width in an inside direction to the portion separated in needle drop point by more than the specified distance in FIG. 10.

For example, as shown in FIG. 10 and FIG. 11, instead of tearing stitch data 33D (see FIG. 4 and FIG. 5) for forming the tearing stitch 33, tearing stitch data 63D for forming tearing stitches 63 may be disposed between adjacent needle drop points QN and Q (N+1) separated from each other-by more than a specified distance.

This tearing stitch data 63D is embroidery data for forming a tearing stitches 63 of satin stitching, so that outside needle drop points R1, R3, R5, . . . , R15 may be disposed on the contour line between adjacent needle drop points QN and Q (N+1), separated from each other by more than a specified distance, and so that inside needle drop points R2, R4, R6, . . . , R14 may be disposed so as to be increased gradually in stitch width in an inside direction of the embroidery region from both ends of the sewing direction towards the central position.

At S5, the CPU 22 reads out from the ROM 23 tearing stitch data 63D for forming a needle drop point nearby, between adjacent needle drop points P1 and P2 and needle drop points P (n−1) and Pn separated from each other by more than a specified distance in embroidery data of stitch 61 (hereinafter embroidery data 61), adds to embroidery data 61 and stores in the embroidery data memory area.

As a result, after an item of three-dimensional embroidery has been formed, the residual and redundant portion of the elastic sheet 42 can be easily torn off from the fabric 41 along the stitch corresponding to the needle drop points P1 to Pn and the needle drop points R1, R3, R5, . . . , R15. Since a stitch of satin stitching produced by tearing stitch data 63D is a stitch different in stitch width in an inside direction of the embroidery region in relation to the contour line, after embroidery has been sewn by embroidery data 61, the small protrusion is prevented from being formed by stitchesatin stitching on the inside, and the appearance can be enhanced.

At S6, when tearing stitch data 63D of tearing stitch 63 of satin stitching having needle drop points R1, R3, R5, . . . , R15 disposed on contour line 62 is added to embroidery data 61, the tearing stitch data 63D is added in such a way that the sewing sequence of tearing stitches 63 of satin stitching is ahead of the sewing sequence of stitches of the embroidery pattern main body in the embroidery region. As a result, the tearing stitch 63 of satin stitching produced by tearing stitch data 63D are concealed beneath the stitches of embroidery data 61 in an embroidery region to be sewn later, and in consequence excessive stitches are not conspicuous, and the appearance may be further enhanced.

EXEMPLARY EMBODIMENT 4

Figure 12:
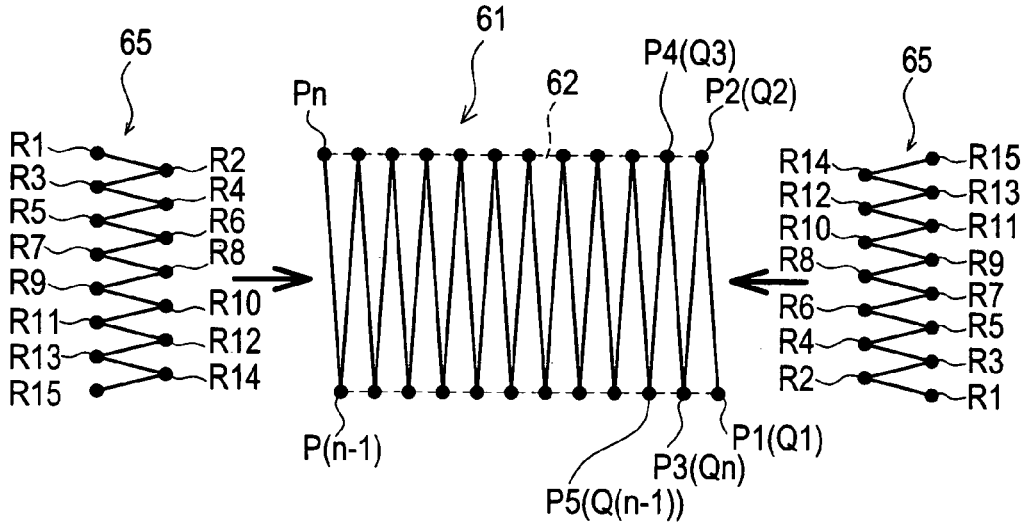
FIG. 12 is a diagram of an example of a portion among needle drop points formed on a contour line that have been extracted from embroidery data in the embroidery data processing device at a different exemplary embodiment, separated by more than a specified distance.
Figure 13:
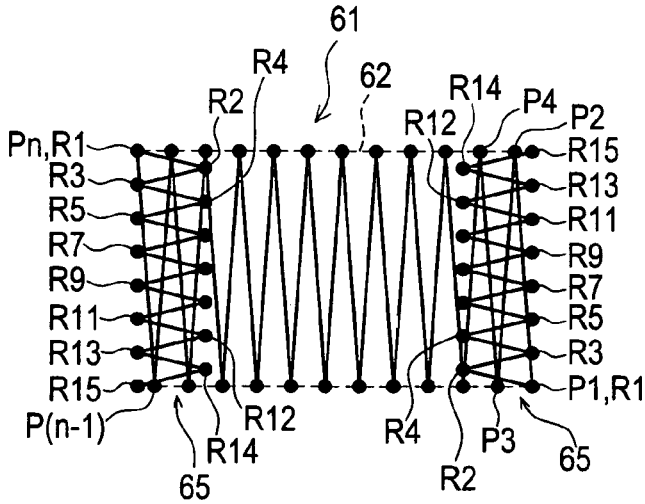
FIG. 13 is an explanatory diagram of a portion of stitch data of satin stitching that has been added and that is identical in stitch width in an inside direction to the portion separated in needle drop point by more than the specified distance in FIG. 12.

For example, as shown in FIG. 12 and FIG. 13, instead of tearing stitch data 33D (see FIG. 4 and FIG. 5) for forming the tearing stitch 33, tearing stitch data 65D for forming tearing stitch 65 may be disposed between adjacent needle drop points QN and Q (N+1) separated from each other by more than a specified distance.

This tearing stitch data 65D is embroidery data for forming a tearing stitch 65 of satin stitching, so that outside needle drop points R1, R3, R5, . . . , R15 may be disposed on the contour line between adjacent needle drop points QN and Q (N+1) separated from each other by more than a specified distance, and so that inside needle drop points R2, R4, R6, . . . , R14 may be disposed so as to be identical in stitch width in an inside direction of the embroidery region.

At S5, the CPU 22 reads out from the ROM 23 tearing stitch data 65D for forming a needle drop point nearby, between adjacent needle drop points P1 and P2, and between needle drop points P (n−1) and Pn separated from each other by more than a specified distance, a needle drop point stored in embroidery data of stitch 61 (embroidery data 61), adds the tearing stitch data 65D to embroidery data 61 and stores in the embroidery data memory area.

As a result, after three-dimensional embroidery has been formed, the residual and redundant portion of elastic sheet 42 can be easily torn off from the fabric 41 along the stitch corresponding to the needle drop points P1 to Pn and the needle drop points R1, R3, R5, . . . , R15.

At S6, when tearing stitch data 65D of satin stitching having needle drop points R1, R3, R5, . . . , R15 disposed on contour line 62 is added to embroidery data 61, the tearing stitch data 65D is added in such a way that the sewing sequence of stitches of satin stitching is ahead of the sewing sequence of stitches of the embroidery pattern main body in the embroidery region. As a result, the tearing stitch 65 of satin stitching by tearing stitch data 65D is concealed beneath the stitches of embroidery data 61 in an embroidery region to be sewn later, and in consequence excessive stitches are not conspicuous, and the appearance may be further enhanced.

EXEMPLARY EMBODIMENT 5

Figure 14:
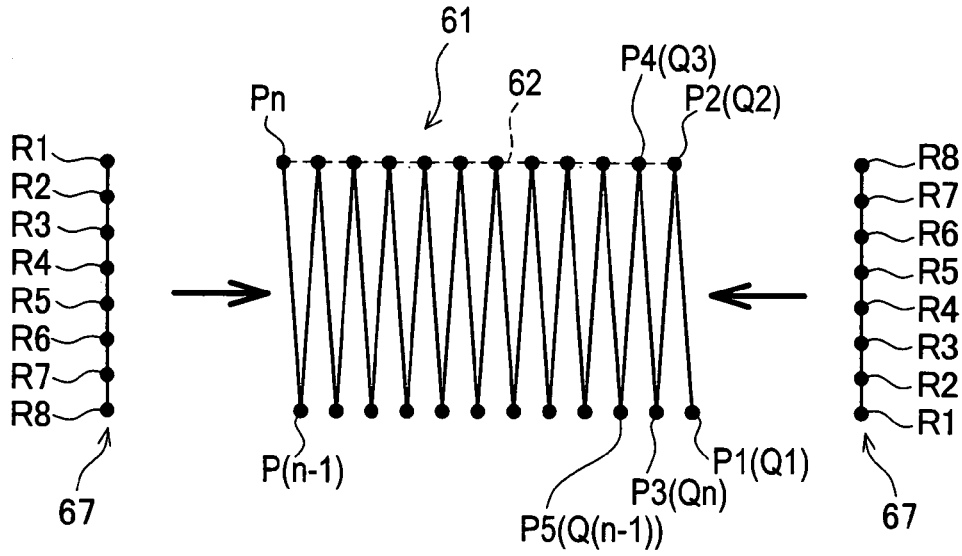
FIG. 14 is a diagram of an example of a portion among needle drop points formed on a contour line that have been extracted from embroidery data in the embroidery data processing device at a different exemplary embodiment, separated by more than a specified distance.
Figure 15:
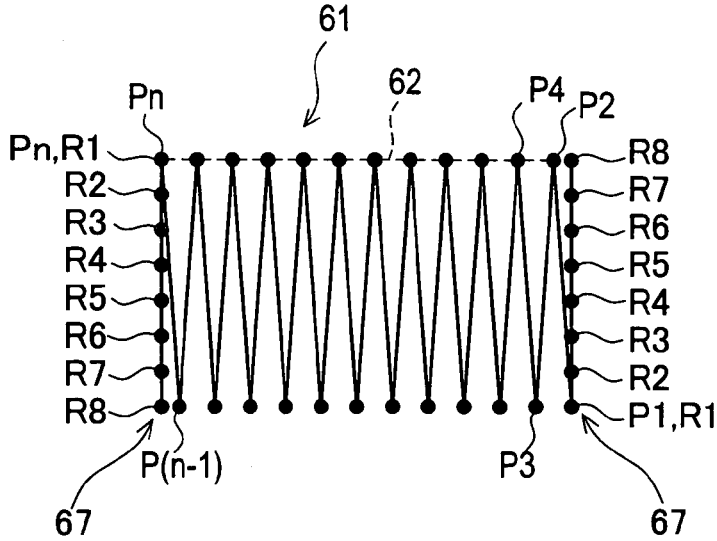
FIG. 15 is an explanatory diagram of a portion of stitch data of straight stitch added to a portion separated in needle drop point by more than a specified distance, as in FIG. 14.

For example, as shown in FIG. 14 and FIG. 15, instead of tearing stitch data 33D (see FIG. 4 and FIG. 5) for forming the tearing stitch 33, tearing stitch data 67D for forming tearing stitch 67 may be disposed between adjacent needle drop points QN and Q (N+1) separated from each other by more than specified distance.

This tearing stitch data 67D is embroidery data for forming a tearing stitch 67 of straight stitch, so that needle drop points R1, R2, R3, . . . , R8 may be disposed linearly at a specified stitch pitch (for example, a stitch pitch of 0.25 mm to 1.0 mm).

At S5, the CPU 22 reads out from the ROM 23 tearing stitch data 67D for forming a needle drop point nearby, between adjacent needle drop points P1 and P2 and needle drop points P (n−1) and Pn separated from each other by more than a specified distance, a needle drop point stored in embroidery data of stitch 61 (embroidery data 61), adds the tearing stitch data 67D to embroidery data 61 and stores in the embroidery data memory area.

As a result, after three-dimensional embroidery has been formed, the residual and redundant portion of the elastic sheet 42 can be easily torn off from the fabric 41 along the stitch corresponding to the needle drop points P1 to Pn and the needle drop points R1, R2, R3, . . . , R8.

At S6, when tearing stitch data 67D of straight tearing stitch 67 having needle drop points R1, R2, R3, . . . , R8 disposed on contour line 62 is added to embroidery data 61, the tearing stitch data 67D is added so that the sewing sequence of stitches of straight tearing stitch 67 is ahead of the sewing sequence of stitches of the embroidery pattern main body in the embroidery region. As a result, the tearing stitch 67 of straight tearing stitch data 67D is concealed beneath the stitch of embroidery data 61 in an embroidery region to be sewn later, and in consequence excessive stitches are not conspicuous, and the appearance may be further enhanced.

While the presently exemplary embodiment of the disclosure has been shown and described, it is to be understood that this disclosure is for the purpose of illustration and that various changes and modifications may be made without departing from the scope of the disclosure as set forth in the appended claims.

What is claimed is:

1. An embroidery data-processing device comprising:

a contour-extracting device that extracts a contour line for depicting an embroidery region on a basis of pattern data;

an embroidery data-creating device that creates embroidery data in order to form an embroidery stitch within the contour line;

a judging device that judges on the basis of the embroidery data whether adjacent needle drop points separated from each other by more than a specified distance on the contour line exist among needle drop points on the contour line; and a stitch data-adding device that adds to the embroidery data, stitch data of a specific stitch to be formed so that a needle drop point may be disposed nearby on the contour line between the adjacent needle drop points when the judging device judges that adjacent needle drop points separated from each other by more than a specified distance do exist on the contour line.

2. The embroidery data processing device according to claim 1, wherein the stitch data is for forming a straight stitch of a specified stitch pitch.

3. The embroidery data processing device according to claim 1, wherein the stitch data is for forming a stitch of satin stitching to be disposed near to the needle drop points on the contour line.

4. The embroidery data processing device according to claim 3, wherein the satin stitching is a stitch different in stitch width in an inside direction of the embroidery region relative to the contour line.

5. The embroidery data processing device according to claim 1, wherein, when the stitch data is added to the embroidery data, the stitch data-adding device adds the stitch data in such a way that a sewing sequence of the specific stitch is ahead of a sewing sequence of stitches in the embroidery region.

6. An embroidery data-processing device comprising:

an embroidery data-reading device that reads in embroidery data including positional data of needle drop points for forming an embroidery stitch by means of an embroidering machine;

a contour-extracting device that extracts on a basis of embroidery data being read in by the embroidery-data reading device, a contour line for depicting an embroidery region;

a judging device that judges on the basis of the embroidery data whether adjacent needle drop points separated from each other by more than a specified distance on the contour line exist among needle drop points on the contour line; and a stitch data-adding device that adds to the embroidery data, stitch data of a specific stitch to be formed so that a needle drop point may be disposed nearby on the contour line between the adjacent needle drop points when the judging device judges that adjacent needle drop points separated from each other by more than a specified distance do exist on the contour line.

7. The embroidery data processing device according to claim 6, wherein the stitch data is for forming a straight stitch of a specified stitch pitch.

8. The embroidery data processing device according to claim 6, wherein the stitch data is for forming a stitch of satin stitching to be disposed near to the needle drop points on the contour line.

9. The embroidery data processing device according to claim 8, wherein the satin stitching is a stitch different in stitch width in an inside direction of the embroidery region relative to the contour line.

10. The embroidery data processing device according to claim 6, wherein the stitch data adding device adds the stitch data to the embroidery data so that a sewing sequence of the specified stitch may be ahead of the sewing sequence of the stitch in the embroidery region, when adding the stitch data to the embroidery data.

11. A computer program product used and executed by an embroidery data-processing device comprising:

a recording medium that can be read by a computer; and a computer program stored in the recording medium that can be read by the computer, wherein the computer program comprises:

a contour extracting step of extracting a contour line for depicting an embroidery region on a basis of pattern data;

an embroidery data creating step of creating embroidery data in order to form an embroidery stitch within the contour line;

a judging step of judging, on the basis of the embroidery data, whether adjacent needle drop points separated from each other by more than a specified distance on the contour line exist among needle drop points on the contour line; and a stitch data-adding step of adding to the embroidery data, stitch data of a specified stitch to be formed so that a needle drop point may be disposed closely on the contour line between the adjacent needle drop points when the judging step judges that adjacent needle drop points separated from each other by more than a specified distance do exist on the contour line.

12. The computer program product according to claim 11, wherein the stitch data is stitch data for forming a straight stitch of a specified stitch pitch.

13. The computer program product according to claim 11, wherein the stitch data is for forming a stitch of satin stitching to be disposed near to the needle drop points on the contour line.

14. The computer program product according to claim 13, wherein the satin stitching is a stitch different in stitch width in an inside direction of the embroidery region relative to the contour line.

15. The computer program product according to claim 11, wherein, when the stitch data is added to the embroidery data, in the stitch data-adding step, the stitch data is added in such a way that a sewing sequence of the specific stitch is ahead of a sewing sequence of stitches in the embroidery region.

16. A computer program product used and executed by an embroidery data-processing device comprising:

a recording medium that can be read by a computer; and a computer program stored in the recording medium that can be read by the computer, wherein the computer program comprises:

an embroidery data-reading step of reading in embroidery data including positional data of needle drop points for forming an embroidery stitch by means of an embroidering machine;

a contour-extracting step of extracting, on a basis of embroidery data read in by the embroidery reading device, a contour line for depicting an embroidery region;

a judging step of judging, on the basis of the embroidery data, whether adjacent needle drop points separated from each other by more than a specified distance on the contour line exist among needle drop points on the contour line; and a stitch data-adding step of adding to the embroidery data, stitch data of a specific stitch to be formed so that a needle drop point may be disposed nearby on the contour line between the adjacent needle drop points when the judging step judges that adjacent needle drop points separated from each other by more than a specified distance do exist on the contour line.

17. The computer program product according to claim 16, wherein the stitch data is for forming a straight stitch of a specified stitch pitch.

18. The computer program product of claim 16, wherein the stitch data is for forming a stitch of satin stitching to be disposed near to the needle drop points on the contour line.

19. The computer program product according to claim 18, wherein the satin stitching is a stitch different in stitch width in an inside direction of the embroidery region relative to the contour line.

20. The computer program product according to claim 16, wherein, when the stitch data is added to the embroidery data, in the stitch data-adding step, the stitch data is added in such a way, that a sewing sequence of the specific stitch is ahead of a sewing sequence of stitches in the embroidery region.

* * * * *